US005482213A

United States Patent [19]

Matsusaka et al.

[11] Patent Number: 5,482,213

[45] Date of Patent: Jan. 9, 1996

[54] FUEL INJECTION VALVE OPERATED BY EXPANSION AND CONTRACTION OF PIEZOELECTRIC ELEMENT

[75] Inventors: Masanobu Matsusaka, Handa; Susumu Sugimoto, Obu; Motonobu Akaki, Anjo; Yasutoshi Yamada, Aichi, all of Japan

[73] Assignee: Aisin Seiki Kabushiki Kaisha, Kariya, Japan

[21] Appl. No.: 249,991

[22] Filed: May 27, 1994

[30] Foreign Application Priority Data

May 31, 1993 [JP] Japan ..... 5-154387
May 31, 1993 [JP] Japan ..... 5-154388

[51] Int. Cl.[6] ..... B05B 1/30

[52] U.S. Cl. ..... 239/584

[58] Field of Search ..... 123/90.61, 90.51; 239/584, 585.1–585.5, 102.2; 310/328; 251/129.02, 129.05, 129.01

[56] References Cited

U.S. PATENT DOCUMENTS

| | | | |
|---|---|---|---|
| 4,101,076 | 7/1978 | Bart | 239/584 |
| 4,669,660 | 6/1987 | Weber et al. | 239/584 X |
| 4,725,002 | 2/1988 | Trachte | 239/533.2 X |
| 4,728,074 | 3/1988 | Igashira et al. | 251/57 |
| 4,907,748 | 3/1990 | Gardner et al. | 239/584 |
| 4,909,440 | 3/1990 | Mitsuyasu et al. | 239/96 |

FOREIGN PATENT DOCUMENTS

| | | | |
|---|---|---|---|
| 2586758 | 3/1987 | France | 239 X/102.2 |
| 3030378 | 2/1982 | Germany | 239/102.2 |
| 2-112663 | 4/1990 | Japan . | |

*Primary Examiner*—Kevin P. Weldon
*Attorney, Agent, or Firm*—Burns, Doane, Swecker & Mathis

[57] ABSTRACT

A fuel injection valve comprises a valve body having a injection port at an edge thereof, a needle valve member interposed in the valve body and opening or closing the injection port, a first spring member for energizing the needle valve member in a one direction, a piezoelectric device being a piezoelectric element having a cylindrical body mounted on the interior of the valve body in a condition that a positive or negative voltage is applied, and controlling the needle valve member in the direction of opening the injection port by applying a voltage changed over positively or negatively at the time of fuel injection while pushing the needle valve member in the opposite direction in response to the energizing direction of the first spring member, and a second spring member for providing a larger energizing force than the energizing force of the first spring member described above and being interposed between the valve body and the piezoelectric device described above. The fuel injection valve described above has a high durability and a large amount of fuel injection and is compact.

11 Claims, 7 Drawing Sheets

FUEL INJECTION VALVE OPERATED BY EXPANSION AND CONTRACTION OF PIEZOELECTRIC ELEMENT

BACKGROUND OF THE INVENTION

1. Field of the Invention

The present invention relates to a fuel injection valve for controlling a needle valve member in the direction of opening of an injection port by the deformation due to the action that a piezoelectric device having a cylindrical body thereof is installed to a valve body in the condition that a positive or negative voltage is applied and the voltage changed-over to a negative or positive voltage is applied at a fuel injection time.

2. Description of the Prior Art

A conventional fuel injection valve (Japanese Pat. application 2-112663) was constituted as shown in FIG. 7, illustrating that a needle valve N is co-axially interposed in a valve case C having an injection port O, a spring B is also interposed between the needle valve N and a valve cover F, and a hollow cylindrical piezoelectric device P shown in FIG. 8 is installed coaxially with the needle valve N between a shoulder portion S of the needle valve N and a point E of the valve case C without applying any voltage.

Since the fuel injection valve described above was interposed between the needle valve N and the valve case C and accordingly the hollow cylindrical piezoelectric device P was used, there was the disadvantage that cracks occur due to the repetition of expansion and contraction, resulting in disruption and a shortening of the service life in case there is any flaw due to the process and molding on the inner surface thereof.

In addition, since at the time of fuel injection the fuel injection valve described above injects fuel from the injection port 0 by applying, for example, a positive voltage on the piezoelectric device P and accordingly by moving the needle valve N axially and to the left on FIG. 7 while expanding axially in accordance with the positive voltage applied against the spring force by a spring B, there were the disadvantages that an insufficient amount of fuel injection can be achieved because of a small amount of deformation in the piezoelectric device P and it is necessary to make the axial length thereof significantly long by increasing the number of layers of piezoelectric elements in order to obtain the full stroke in the needle valve N, resulting in making the fuel injection valve long.

SUMMARY OF THE INVENTION

It is a general object of this invention to enhance the durability of a fuel injection valve to extend a service life thereof by preventing the occurrence of any crack in a piezoelectric device.

Another object of the invention is to increase a fuel injection amount by enlarging the stroke of a needle valve member.

A further object of the invention is to make the fuel injection valve compact by shortening the piezoelectric device and the fuel injection valve.

A still further object of the invention is to provide a fuel injection valve based on such a technical idea that a needle valve member thereof is controlled in the direction of opening an injection port thereof by the control of applied voltage using a piezoelectric device having a solid cylindrical body thereof without any inner surface.

A yet further object of the invention is to provide a fuel injection valve based on such a technical idea that an amount of a deformation thereof is enlarged by applying a negative or positive amplitude inversely on the piezoelectric device which was preliminarily provided with a positive or negative amplitude at a fuel injection time.

Another object of the invention is to provide a fuel injection valve comprising: a valve body having an injection port at a tip portion thereof; a needle valve member being interposed in said valve body, for opening or closing said injection port; a first spring member being interposed in said valve body, for energizing said needle valve member in a one direction thereof; and a piezoelectric device comprising a piezoelectric element having a solid cylindrical body interposed in said valve body, for pushing said needle valve member in the opposite direction to the energizing one direction of said first spring member and for controlling said needle valve member in the direction of opening said injection port by controlling of an applied voltage.

A further object of the invention is to provide a fuel injection valve further comprising said piezoelectric element comprising a solid cylindrical body thereof interposed in said valve body on a condition of applying a positive or negative voltage, for pushing said needle valve member in the opposite direction in response to the energizing one direction of said first spring member, and for controlling said needle valve member in the direction of opening said injection port by applying a voltage switched over to a negative or positive voltage at the time of fuel injection.

A still further object of the present invention is to provide a fuel injection valve further comprising a second spring member interposed between said valve body and said piezoelectric device, for applying the larger energizing force to said piezoelectric device than that of said first spring member.

A fuel injection valve of this invention comprising the constitution described above injects a fuel by controlling the needle valve member in the direction of opening the injection port by means of the contraction or expansion of a piezoelectric device having a solid cylindrical body thereof by the intercepting or supply control of the applied voltage on the needle valve member which is being balanced with the aid of a first spring member and the piezoelectric device having a solid cylindrical body thereof.

The fuel injection valve of this invention comprising the constitution described above makes the needle valve member take a stroke largely and enlarges the opening area between the injection port and the needle valve member by deforming the piezoelectric device largely from its expanded or shrunk condition to its inversely shrunk or expanded condition.

The fuel injection valve of this invention comprising the constitution described above prevents the movement of the needle valve member in the direction of opening the needle valve member by the first spring member inherent to a larger energizing force than that of a second spring member being deformed only by the deformation increment described above in the piezoelectric device, even though the piezoelectric device may be deformed by its natural discharge since no voltage is applied on the piezoelectric device at the time of engine stop.

A fuel injection valve of this invention comprising the operation described above has the effect of enhancing its durability and extending its service life by preventing the generation of the cracks caused by any flaw on an inner surface thereof, since the piezoelectric device having a solid cylindrical body and only an outer wall thereof without any inner surface thereof is shrunk or expanded by the shutdown or supply of an applied voltage.

The fuel injection valve of this invention comprising the operation described above has the effect of being capable of making itself compact by shortening the piezoelectric device and the fuel injection valve itself in the case that the fuel injection amount is increased and also kept constant by increasing the deformation increment of the piezoelectric device and accordingly enlarging the stroke of the needle valve member.

The fuel injection valve of this invention comprising the operation described above has the effect of making it possible to open the needle valve member and then to prevent the fuel from being injected, since the movement in the needle valve member is prevented by compensating the deformation due to the natural discharge of the piezoelectric device with the deformation in the second spring member at the time of engine stop.

DETAILED DESCRIPTION OF THE PREFERRED EMBODIMENTS

Figure 1:
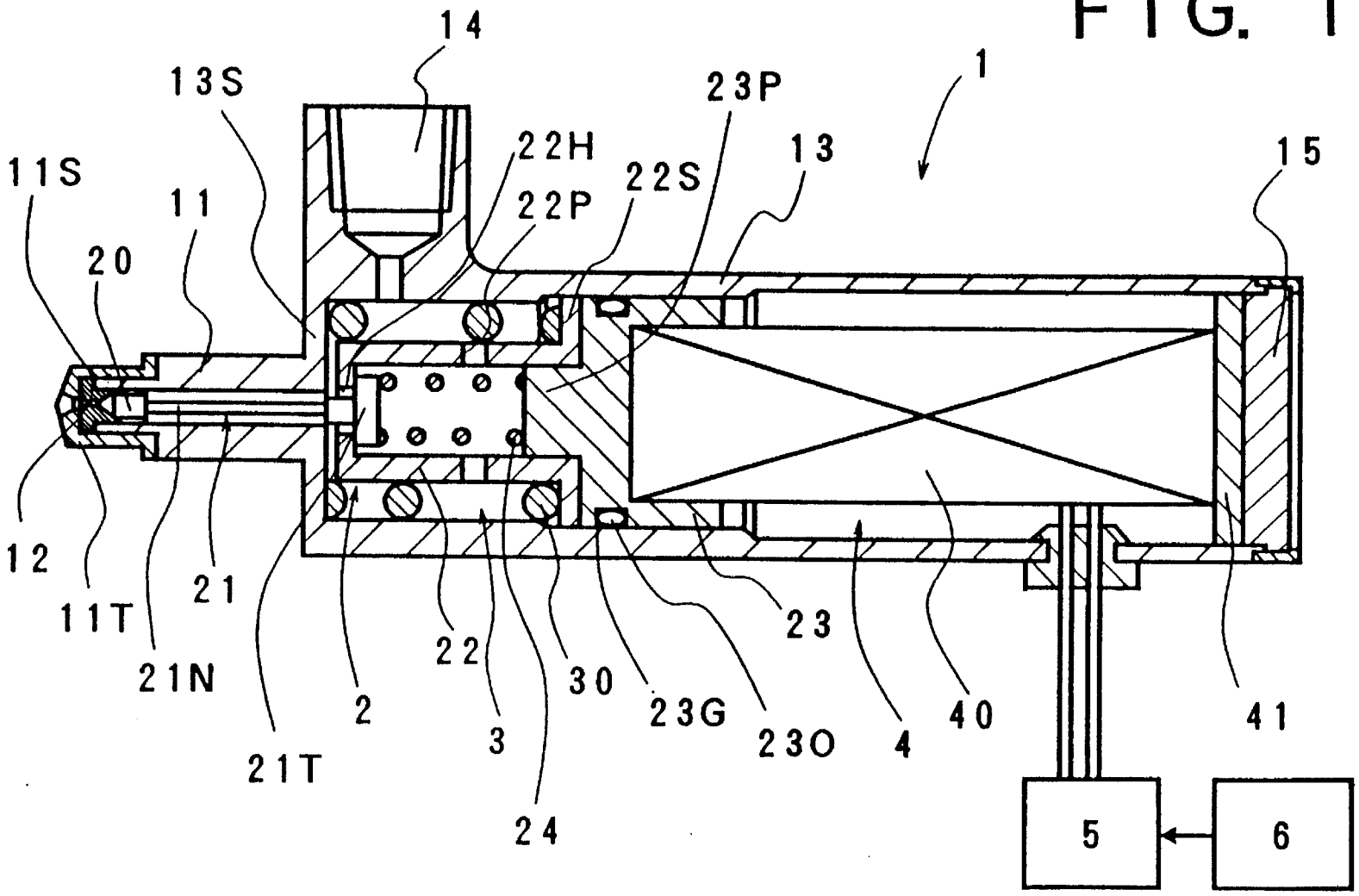
FIG. 1 is a vertical sectional view showing a fuel injection valve as a first preferred embodiment of this invention.

Referring now to the drawings, the detailed description of a fuel injection valve as a preferred embodiment of the invention will be given in the following.

The First Preferred Embodiment

The fuel injection valve of a first preferred embodiment comprises: a valve body 1 having an injection port 12 at a tip portion of a small diameter portion 11 thereof and a fuel injection inlet 14 at a large diameter portion 13 thereof; a needle valve member 2 including a first member 21 of a small diameter having an inner valve 20 interposed in the small diameter portion 11 of the valve body 1, a second member 22 interposed in the large diameter portion 13 and a third member 23 in contact with the second member; a first spring member 3 comprising a coil spring 30 interposed between the second member 22 of the needle valve member 2 and the large diameter portion 13 and for energizing the needle valve member 2 in the direction of opening; a piezoelectric device 4 comprising a piezoelectric element having a solid cylinder 40 interposed in such a condition that is applied by any positive voltage so as to be expanded between the third member 23 of the needle valve member 2 and the a cover portion 15 of the valve body 1 and capable of controlling in the direction of opening the needle valve portion 2 by the contraction thereof when the applied voltage is interrupted; a driving circuit 5 for driving said piezoelectric device 4; and an EFI computer 6 for controlling said driving circuit 5.

As shown in FIG. 1, the valve body 1 is a hollow cylindrical body 10 comprising the small diameter portion 11 and the large diameter portion 13. A valve seat portion 11S having a rough T shape in vertical section and a roughly U-shaped point 11T are installed to the opening of the small diameter portion 11. A fuel leading port 14 is formed at the shoulder portion 135 of the large diameter portion 13. The opening edge of the large diameter portion 13 is installed with the cover portion 15. The large diameter portion 13 has internal surfaces having three different diameters and is formed so that these diameters gradually increase as it approaches the opening edge.

The first member 21 of the needle member 2 comprises a member having an approximate T shape in vertical section as shown in FIG. 1 and comprises a T shape portion 21T associated with both a convergent inner valve 20 in contact with the valve seat portion 11S and the second member 22; and a small and rod-like connection portion 21N for connecting the edge of the inner valve 20 to the T shape portion 21T.

The second member 22 of the needle valve member 2 comprises a member having a vertical section of an approximate U shape, and a hole portion 22H for interposing the T shape portion 21T of the first member 21 in the bottom portion of the edge thereof and a through-hole 22P at the side wall thereof are both formed.

The third member 23 of the needle valve member 2 is composed of a member having a vertical section in an approximate U form, a projecting portion 23P for projecting onto the internal surface of the second member 22 formed at an edge thereof, an annular groove 23G formed on an external surface thereof, and an O-ring 230 for intercepting the fuel interposed therein, respectively.

A coil spring 24 for pushing the first member 21 onto the valve seat portion 11S of the valve body 1 by a constant energizing force is interposed between the T shape portion 21T of the first member 21 of the needle valve member 2 and the projecting portion 23P of the third member.

The first spring member 3 is composed of the coil spring 30 interposed between the shoulder portion 13S of the large diameter portion 13 of the valve body 1 and the second member 22S of the needle valve member 2, and comprises the structure for energizing with a constant energizing force at all the time in the direction of spacing the needle valve member 2 apart from the injection port 12 of the valve body 1.

The piezoelectric device 4 comprises a solid cylinder 40 made of multiple axially laminated piezoelectric elements having solid disc plates and interposed with a spacer 41 having a proper thickness between the bottom portion of the third member 23 of the needle valve member 2 and the cover portion 15 of the valve body 1 in an axially expanded condition thereof by applying a positively applied constant voltage. The device 4 comprises the structure for bringing the inner valve 20 of the needle valve member 2 into contact with the injection port 12 against the energizing force of the first spring member 3.

When a voltage applied on the piezoelectric device 4 is switched to a negative constant voltage at the time of fuel injection, the piezoelectric device 4 shrinks or contracts axially and is designed to make the inner valve 20 of the needle valve member 2 spaced apart from the valve seat portion 11S of the injection port 12 by means of the energizing force of the coil spring 30 of the first spring member 3 and makes it possible to inject the fuel from the injection port 12.

Figure 2:
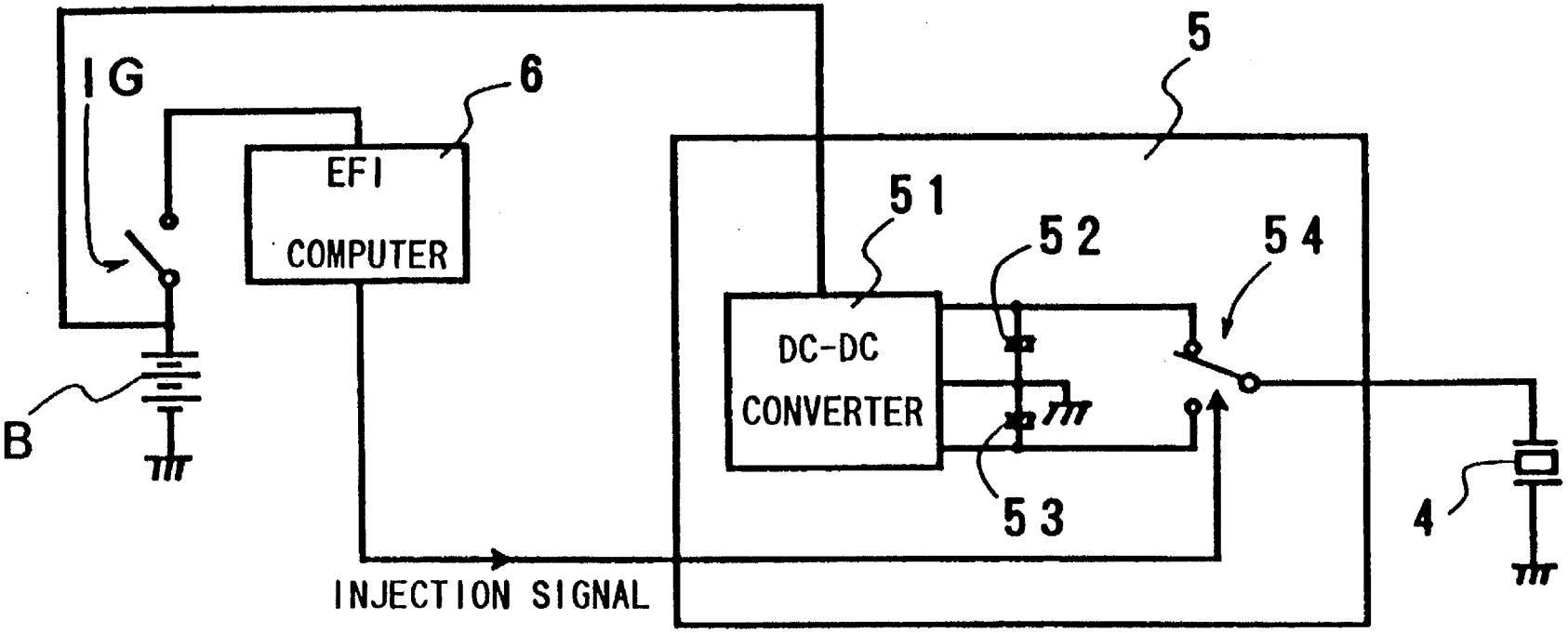
FIG. 2 is a block diagram showing a driving circuit of the first preferred embodiment.

The driving circuit 5 is directly connected with a battery B as shown in FIG. 2 and comprises a DC—DC converter 51, condensers 52 and 53 connected in series and grounded at a middle point thereof and a change-over switch 54. The circuit is designed so that a positive or negative constant voltage is applied on the piezoelectric device 4 by means of the change-over switch 54.

The EFI computer 6 is connected with the battery B through the ignition switch IG and is designed to change over the change-over switch 54 of the driving circuit 5 in response to each gas cylinder to a terminal which is supplied with a negative constant voltage by generating the injection signal of each gas cylinder in synchronization with the engine rotation.

In the fuel injection valve of the first preferred embodiment comprising the constitution described above, a positive constant voltage from the condenser 52 at the positive side is applied on the piezoelectric device 4 through the change-over switch 54 at no fuel injection time and the piezoelectric device 4 thereby expands axially against the coil spring 30, so that the inner valve 20 of the needle valve member 2 is in contact with the valve seat portion 11S of the injection port 12.

Once a fuel injection signal is generated from the EFI computer 6 in this condition, the change-over switch 54 is switched so as to apply a negative constant voltage from the condenser 53 at the negative side on the piezoelectric device 4. Thus, the piezoelectric device 4 is shrunk or contracted axially from its expanded condition to its contracted condition, the needle valve member 2 is spaced moved to its right side on FIG. 4, and therefore, the inner valve 20 is apart from the valve seat portion of the injection port 12, resulting in injecting the fuel from the injection port.

The fuel injection valve comprising the above-mentioned operation as a first preferred embodiment has the effect of enhancing the durability thereof and extending the service life thereof. That is because this fuel injection valve expands or contracts a piezoelectric device 4 comprising a piezoelectric element having a solid cylinder 40, and therefore, there are no occurrence and disruption of the cracks caused by any flaw on an inner cylindrical surface thereof in a manner similar to that in the prior art devices which utilize the piezoelectric device having a hollow cylindrical body.

Since the fuel injection valve of the first preferred embodiment having the operation described above takes advantage of the both amplitudes of the expansion and contraction of the piezoelectric device 4 by applying the positive or negative constant voltage through the driving circuit 5 and therefore, a large amplitude can be obtained in comparison with that which utilizes only the half amplitude at its positive side in a manner similar to that of the prior art device, this fuel injection valve has the effects of making it possible to reduce the number of the laminated sheets of piezoelectric element in the piezoelectric device 4 in the case of arranging them to have the same amplitude, utilize a short piezoelectric device in axial length and to render the fuel injection valve compact.

The Second Preferred Embodiment

Figure 3:
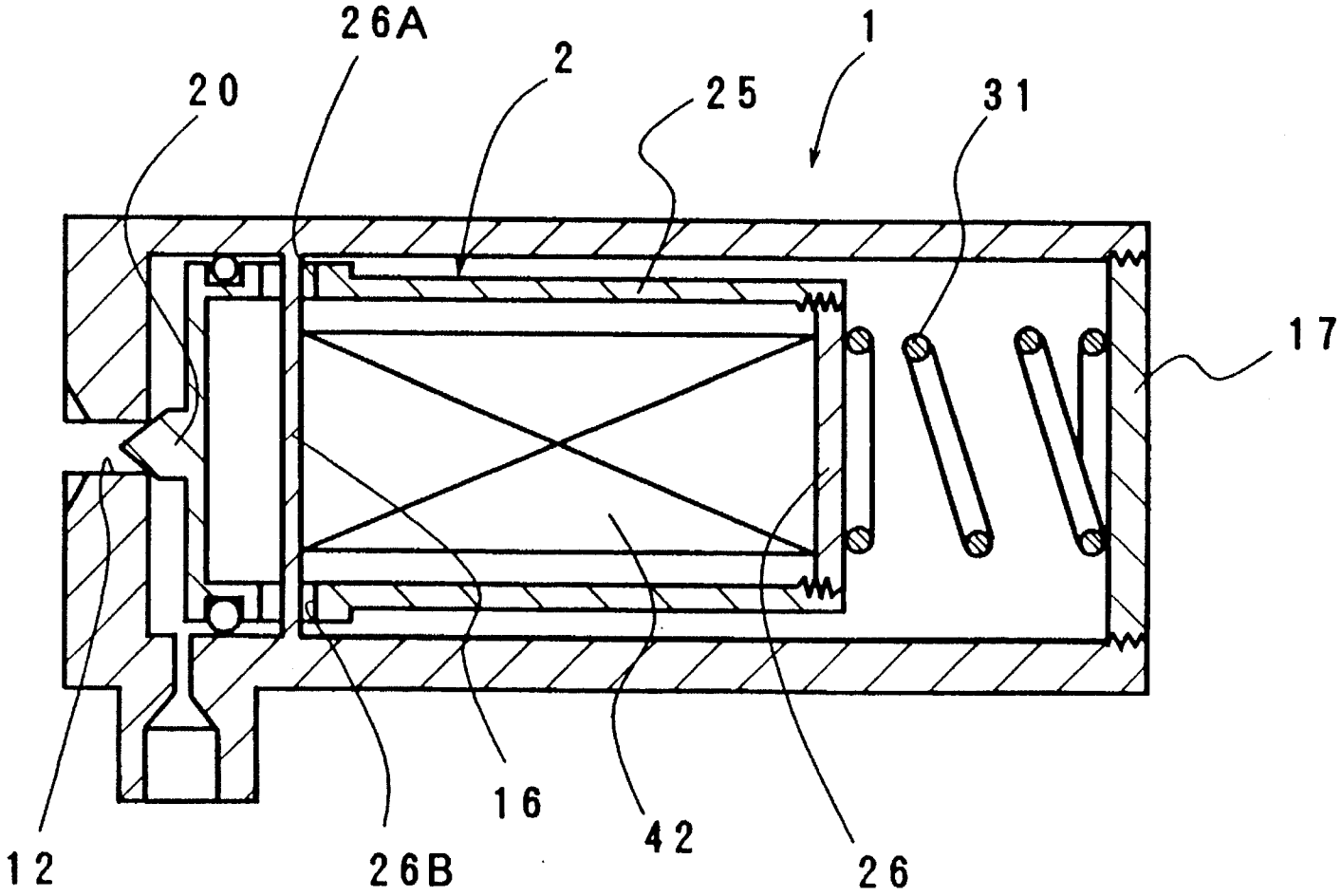
FIG. 3 is a vertical sectional view showing a fuel injection valve as a second preferred embodiment of the invention.

A fuel injection valve of a second preferred embodiment differs from the first embodiment in that the positional relation between the coil spring 30 and the piezoelectric device 4 is inverted as shown in FIG. 3, and there are main different points in the fuel injection valves between the first and second preferred embodiments. The needle valve member 2 comprises a hollow cylinder 25 having openings 26A and 26B formed on a side wall thereof, and a connection portion 16 for connecting the side walls of the valve body 1 is interposed therein. A piezoelectric device 42 comprises a piezoelectric element of a solid polygonal prismatic body between this connection portion 16 and the cover body 26 screwed in the opening of the hollow cylindrical body 25, and a coil spring 31 is interposed in the edges of the cover body 26 and the cover body 17 screwed in the opening of the valve body 1.

In the fuel injection valve comprising the constitution described above of the second preferred embodiment, since a voltage is not applied on the piezoelectric device 42 at the time of no fuel injection, the needle valve member 2 is pushed axially and to the left by the energizing force of the coil spring 31, and the inner valve 20 is in contact with the injection port 12.

In this condition, since the piezoelectric device 42 expands axially from its shrunk condition to its expanded condition by applying a positive voltage, by pushing the needle valve member 2 axially and to the right against the energizing force of the coil spring 31 and then the inner valve 20 is spaced apart from the injection port 12, resulting in fuel injection.

The fuel injection valve comprising the above-mentioned operation as a second preferred embodiment has the effect of enhancing the durability thereof and extending the service life thereof by preventing the generation and distraction of the cracks caused by any flaw on the inner surface thereof, since this fuel injection valve expands or shrinks the piezoelectric device 4 comprising a piezoelectric device 4 having a solid polygonal body in a manner similar with that of the first preferred embodiment.

The fuel injection valve of the second preferred embodiment has the advantage that its assembly is easy, since any voltage is applied on the piezoelectric device 42 only at the time of fuel injection and the fuel injection valve is assembled in a condition that the voltage is not applied on the piezoelectric device 42.

Furthermore, a large amplitude can be obtained since the fuel injection valve of the second preferred embodiment can take advantage of both positive and negative amplitudes in a manner similar to that of the first preferred embodiment if the fuel injection valve is assembled in a condition that any negative voltage is applied on the piezoelectric device 42.

The Third Preferred Embodiment

The fuel injection valve of a third preferred embodiment comprises: a valve body 1 having an injection port 12 at a tip portion of a small diameter portion 11 thereof and a fuel injection inlet 14 at a large diameter portion 13 thereof; a needle valve member 2 including a first member 21 of a small diameter having an inner valve 20 interposed in the small diameter portion 11 of the valve body 1, a second member 22 interposed in the large diameter portion 13 and a third member 23 contacting with the second member 23; a first spring member 3 comprising a coil spring 30 interposed between the second member 22 of the needle valve member 2 and the large diameter portion 13 and for energizing in the direction of opening the needle valve member 2; a piezoelectric device 4 comprising a piezoelectric element having a solid cylinder 40 interposed in such a condition that is applied by any positive voltage so as to be expanded between the third member 23 of the needle valve member 2 and the cover portion 15 of the valve body 1 and capable of controlling in the direction of opening the needle valve portion 2 by the contraction thereof when any negative voltage is applied; a second spring member 7 interposed between the piezoelectric device 4 and the opening of the large diameter portion 13; a driving circuit 5 for changing-over a positive or negative voltage and applying said piezoelectric device 4; and an EFI computer 6 for controlling said driving circuit 5.

Figure 4:
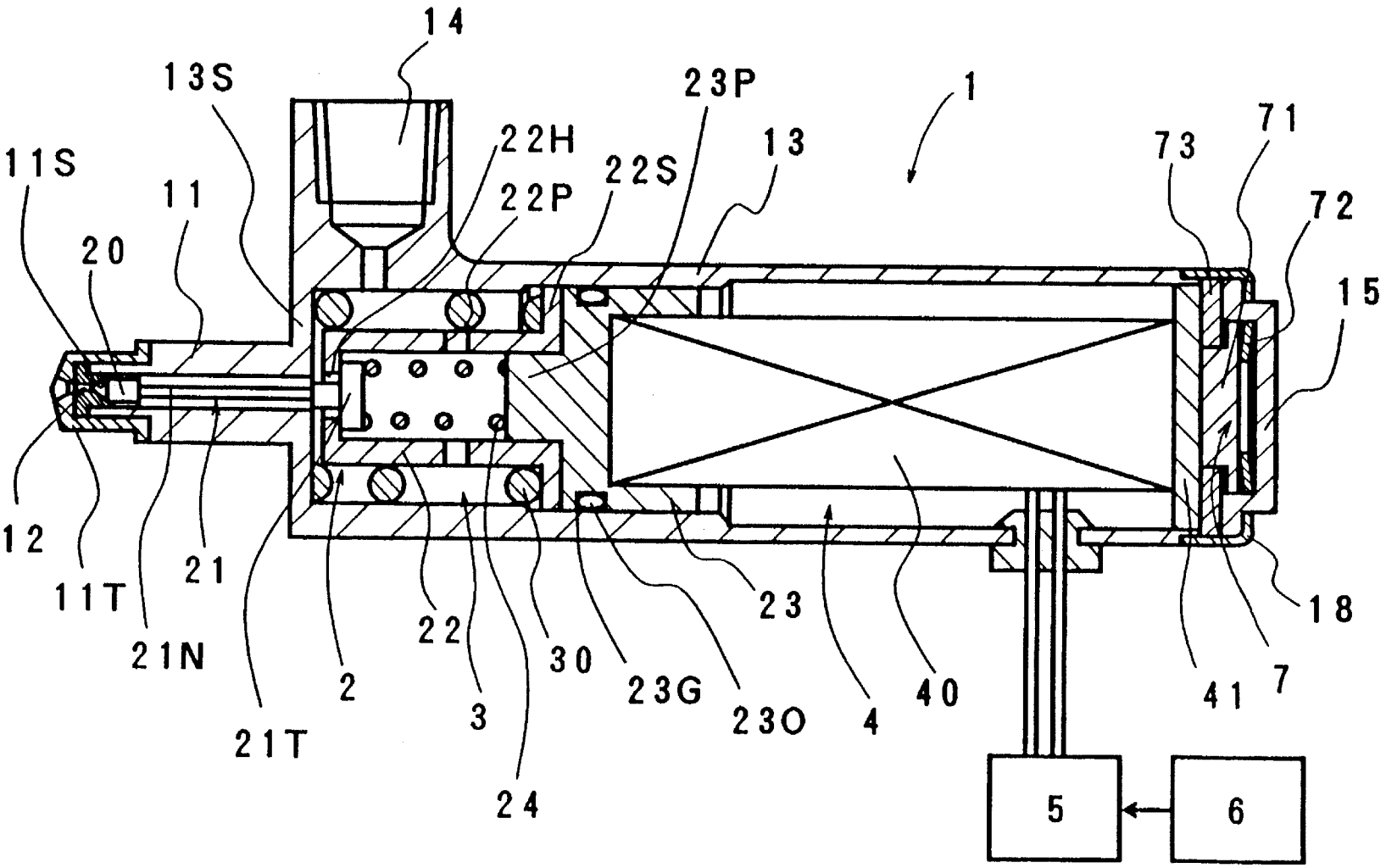
FIG. 4 is a vertical sectional view showing a fuel injection valve as a third preferred embodiment of the invention.

As shown in FIG. 4, the valve body 1 is a hollow cylindrical body 10 comprising the small diameter portion 11 and the large diameter portion 13. A valve seat portion 11S having a rough T shape in vertical section and a roughly U-shaped point 11T are installed at the opening of the small diameter portion 11. A fuel leading port 14 is formed at the shoulder portion 13S of the large diameter portion 13. The opening edge of the large diameter portion 13 is installed with the cover portion 15 having an approximate U shape in longitudinal cross section and an annular anchoring member 18 screwed in the external wall of the large diameter portion 13. The large diameter portion 13 has internal surfaces having three different diameters and is formed so that these diameters become large in a stepwise manner as it approaches the opening edge.

The first member 21 of the needle member 2 comprises a member having an approximate T shape in vertical section as shown in FIG. 4 and comprises a T shape portion 21T associated with both a convergent inner valve 20 in contact with the valve seat portion 11S and the second member 22; and a small and rod-like connection portion 21N for connecting the edge of the inner valve 20 to the T shape portion 21T.

The second member 22 of the needle valve member 2 comprises a member having a vertical section of an approximate U shape, and a hole portion 22H for interposing the T shape portion 21T of the first member 21 in the bottom portion of the edge thereof and a through-hole 22P at the side wall thereof.

The third member 23 of the needle valve member 2 is composed of a member having a vertical section in an approximate U form, a projecting portion 23P formed at an edge thereof for projecting onto the internal surface of the second member 22, an annular groove 23G formed on an external surface thereof, and an O-ring 230 interposed therein for intercepting the fuel therein, respectively.

A coil spring 24 for pushing the first member 21 onto the valve seat portion 11S of the valve body 1 by a constant energizing force is interposed between the T shape portion 21T of the first member 21 of the needle valve member 2 and the projecting portion 23P of the third member.

The first spring member 3 is composed of the coil spring 30 interposed between the shoulder portion 13S of the large diameter portion 13 of the valve body 1 and the second member 22S of the needle valve member 2, and comprises the structure for energizing with a constant energizing force at all the time in the direction which spaces apart the needle valve member 2 from the injection port 12 of the valve body 1.

The piezoelectric device 4 comprises a solid cylinder 40 made of multiple axially laminated piezoelectric elements having their solid disc plates interposed with a spacer 41 having a proper thickness between the bottom portion of the third member 23 of the needle valve member 2 and the cover portion 15 of the valve body 1 in an axially expanded condition thereof by applying a positively applied constant voltage. The device is adapted to bring the inner valve 20 of the needle valve member 2 into contact with the injection port 12 against the energizing force of the first spring member 3.

When a voltage applied on the piezoelectric device 4 is switched to a negative constant voltage at the time of fuel injection, the piezoelectric device 4 contracts axially and is adapted to make the inner valve 20 of the needle valve member 2 apart spaced from the valve seat portion 11S of the injection port 12 by means of the energizing force of the coil spring 30 of the first spring member 3 and to make it possible to inject the fuel from the large opening area formed between the needle valve member 2 and the injection port 12.

The second spring member 7 comprises a contact member 71 having a T shape in vertical section in contact with the center of the spacer 41 which contacts the one end of the piezoelectric device 4, an annular disc spring (belleville spring) 72 interposed between the contact member 71 and the concave portion of the cover portion 15 of the valve body 1, and an annular portion 73 arranged around the injection portion of the contact member 71. The spring member 7 is set so as to take a spring load that is larger than the spring load (constant) of the coil spring 30 described above and that is smaller than the sum of both the propulsive force effecting the needle valve member 2 by means of a fuel pressure (combustion pressure) introduced from the fuel inlet 14 and the spring load of the coil spring 30.

Since the sum of both the spring load of the coil spring 30 and the propulsive force due to the fuel pressure (combustion pressure) is larger than the spring load (constant) of the coil spring 30 described above during the operation of the engine, the disc spring 72 does not substantially effect the needle valve member 2. Since no fuel is supplied from the pump at the time of the engine being stopped (ignition switch IG is off) and the propulsive force due to the combustion pressure does not effect the needle valve member 2 any more, resulting in the large spring load of the disc spring 72 to the spring load of the coil spring 30, the disc spring 72 deforms by the contraction increment due to the natural discharge of the piezoelectric device 4 and comprises the structure of maintaining such a condition that the inner valve 20 of the valve member 2 may be in contact with the injection port 12.

Figure 5:
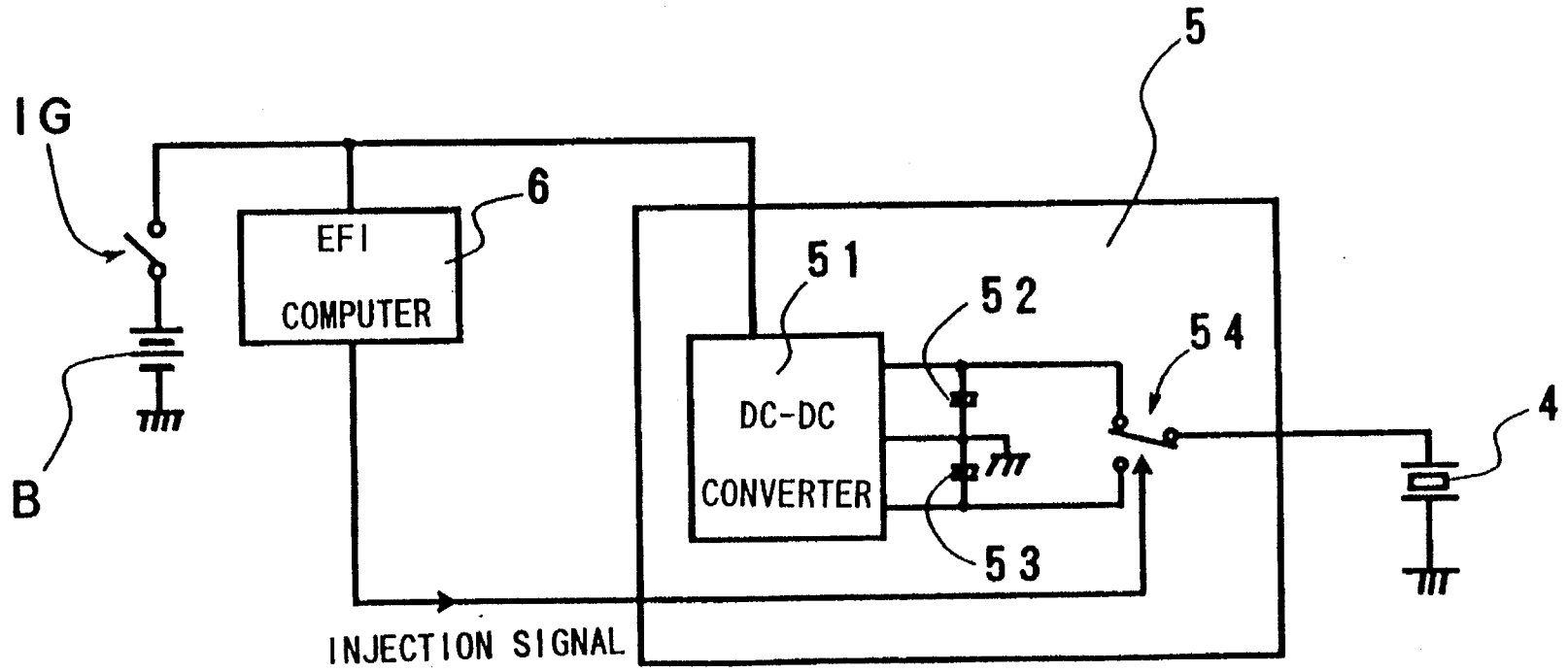
FIG. 5 is a block diagram showing a driving circuit of the third preferred embodiment.

The driving circuit 5 is connected with a battery B through an ignition switch IG as shown in FIG. 5, and comprises a DC-DC converter 51, condensers 52 and 53 connected in series and grounded at a middle point thereof and a change-over switch 54. The circuit 5 is adapted to apply a positive or negative constant voltage on the piezoelectric device 4 by means of the change-over switch 54.

The EFI computer 6 is connected with the battery B through the ignition switch IG and is designed to change over the change-over switch 54 of the driving circuit 5 in response to each gas cylinder to a terminal which is supplied with a negative constant voltage by generating the injection signal of each gas cylinder in synchronization with the engine rotation.

In the fuel injection valve of the third preferred embodiment comprising the constitution described above, a positive constant voltage from the condenser 52 at the positive side is applied on the piezoelectric device 4 through the change-over switch 54 at no fuel injection time and the piezoelectric device 4 thereby expands axially against the coil spring 30, so that the inner valve 20 of the needle valve member 2 is in contact with the valve seat portion 11S of the injection port 12.

Once a fuel injection signal is generated from the EFI computer 6 in this condition, the change-over switch 54 is switched so as to apply a negative constant voltage from the condenser 53 at the negative side on the piezoelectric device 4. Thus, piezoelectric device 4 is contracted axially from its expanded condition to its contracted condition, while the needle valve member 2 makes a large stroke to its right side on FIG. 4, and therefore, the inner valve 20 is apart from the valve seat portion of the injection port 12, resulting in injection fuel from the injection port.

Incidentally, since no propulsive force due to the combustion pressure becomes effective because of no fuel being supplied to the fuel inlet 14 from the pump (not shown) when the engine is stopped, the spring load of the disc spring 72 is larger than that of the coil spring 30. Therefore, no voltage is applied from the driving circuit 5 any more and even though the piezoelectric device 4 may be naturally discharged and shrunk, the resulting increment in contraction maintains such a condition that the disc spring 72 is deformed against the coil spring 30 and that the inner valve 20 is brought into contact with the valve seat portion 11S of the injection port 12.

Since the fuel injection valve of the third preferred embodiment having the operation described above takes advantage of the both amplitudes of the expansion and contraction of the piezoelectric device 4 by applying a negative constant voltage while switching over from a positive one through the driving circuit 5 and therefore, a large amplitude can be obtained in comparison with that which utilizes only the half amplitude at its positive side in a manner similar to that of the prior art device, this fuel injection valve has the effects of making it possible to inject a large quantity of fuel injection by enlarging the stroke of the needle valve member, reduce the number of laminated sheets of the piezoelectric element in the piezoelectric device 4 in the case of arranging them to have the same amplitude, utilize a short piezoelectric device in axial length and render the fuel injection valve compact.

The fuel injection valve of the third preferred embodiment has the effect of preventing the opening of the needle valve member 2 and the injection of the fuel since the increment in contraction accompanying the natural discharge of the piezoelectric device 4 at the time of engine stoppage is compensated with the deformation of the disc spring 72.

The Fourth Preferred Embodiment

Figure 6:
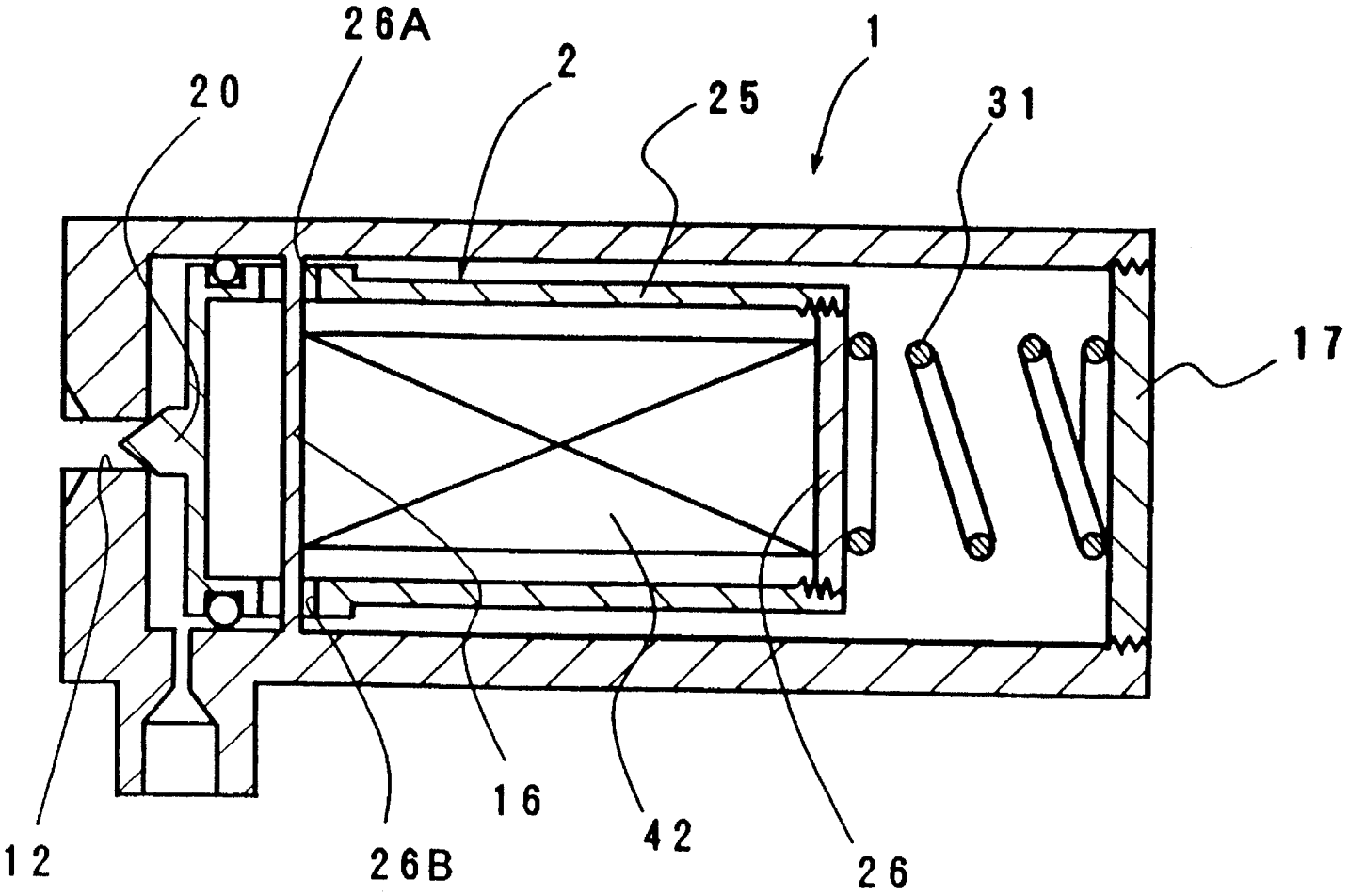
FIG. 6 is a vertical sectional view showing a fuel injection valve as a fourth preferred embodiment of the invention.
Figure 7:
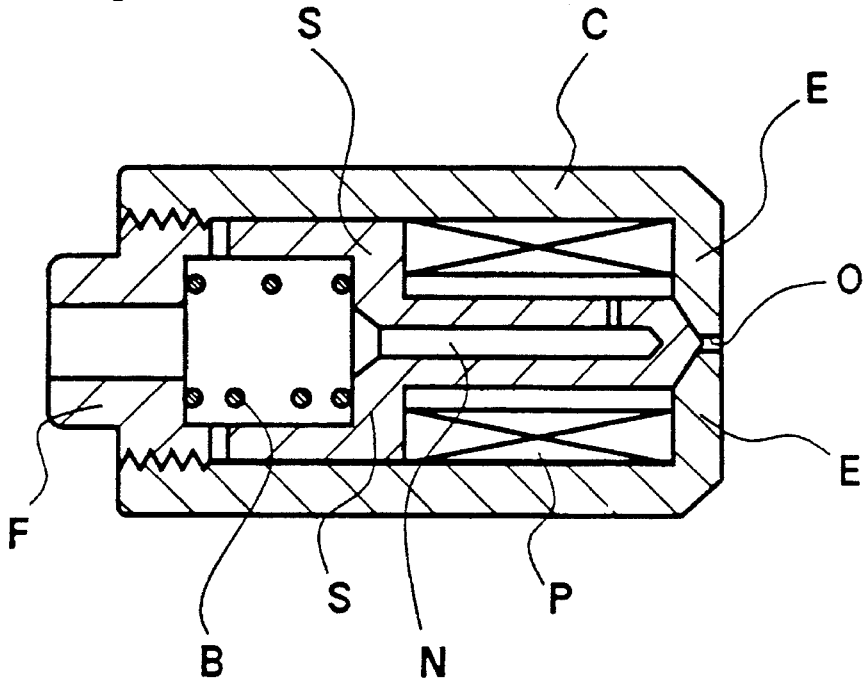
FIG. 7 (PRIOR ART)
FIG. 7 is a vertical sectional view showing a prior art device.
Figure 8:
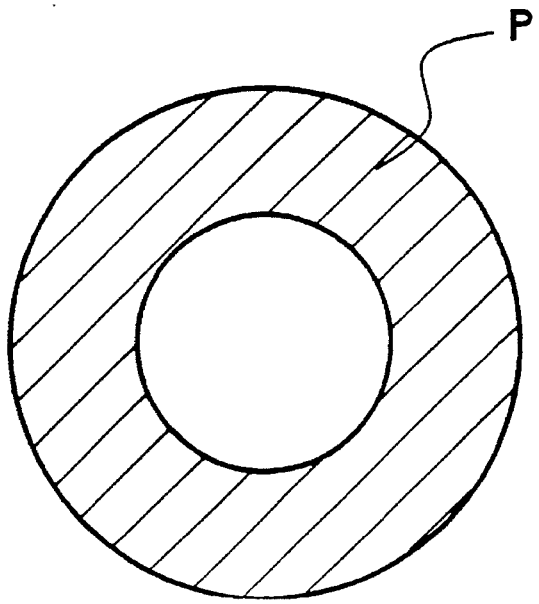
FIG. 8 (PRIOR ART)
FIG. 8 is a cross-sectional view showing a prior art device.

A fuel injection valve of a fourth preferred embodiment differs from that of the third embodiment in that the positional relation between the coil spring 30 and the piezoelectric device 4 is inverted as shown in FIG. 6, and there are main different points in the fuel injection valves between the third and fourth preferred embodiments. The needle valve member 2 comprises a hollow cylinder 25 having openings 26A and 26B formed on a side wall thereof and a connection portion 16 for connecting the side walls of the valve body 1 is interposed therein. A piezoelectric device 42 comprises a piezoelectric element of a solid polygonal prismatic body in its contracted condition by applying a negative voltage between this connection portion 16 and the cover body 26 screwed in the opening of the hollow cylindrical body 25. A coil spring 31 is interposed in the edges of the cover body 26 and the cover body 17 screwed in the opening of the valve body 1, and the second spring member 7 is omitted.

Incidentally, the driving circuit 5 is directly connected with the battery B.

In the fuel injection valve comprising the constitution described above of the fourth preferred embodiment, since a negative constant voltage is applied on the piezoelectric device 42 at the time of no fuel injection, the needle valve member 2 is pushed axially and to the left by the energizing force of the coil spring 31, and the inner valve 20 is in contact with the injection port 12.

In this condition, since the piezoelectric device 42 expands axially from its shrunk condition to its expanded condition by applying a positive voltage, the needle valve member 2 largely makes a stroke by pushing the needle valve member 2 axially and to the right against the energizing force of the coil spring 31 and then the inner valve 20 is spaced apart from the injection port 12, resulting in fuel injection.

The fuel injection valve of the fourth preferred embodiment having the operation described above has the effect of enlarging the stroke of the needle valve member 2 so as to increase an amount of fuel injection and making the piezoelectric device and the fuel injection valve short and compact by taking advantage of both positive and negative amplitude, since the piezoelectric device 42 having a solid and polygonal prismatic body expands from its shrunk condition to its expanded condition.

Incidentally, the fuel injection valve of the fourth preferred embodiment has the effect of making it possible to prevent the opening valve of the needle valve member 2 due to the natural discharge of the piezoelectric device 42 at the time of engine stop, even though the driving circuit 5 may be directly connected with the battery B through the ignition switch, since the similar disc spring to that of the third preferred embodiment is interposed between the bottom portion of the hollow cylindrical body 25 and the connection portion 16.

While the preferred embodiments described above have been disclosed and explained, it is to be understood that the scope of the present invention should not be restricted by these preferred embodiment and any alternations and additions of the invention are possible so long as they do not oppose to the technical idea of this invention which can be admitted by the skilled persons from the patent claims, detailed description of the invention and brief description of the drawings.

Either of the preferred embodiments described above has been described as an example for such examples that the first spring member and the piezoelectric device are wired in series, but the scope of this invention is not always limited to them. For example, in FIG. 6, such a mode is adaptable that the axial length of the injection valve is shortened by anchoring co-axially the both ends between the piezoelectric device 42 and the needle valve member 25 to interpose the coil spring to be used in "tension" and provide it side by side and by omitting the coil spring 31 to be interposed between the cover bodies 26 and 17.

What is claimed:

1. A fuel injection valve comprising:

a valve body having an injection port at a tip portion thereof;

a needle valve member being interposed in said valve body[,] for opening or closing said injection port;

a first spring member being interposed in said valve body for biasing said needle valve member in one direction;

a piezoelectric device comprising a piezoelectric element having a solid cylindrical body interposed in said valve body for pushing said needle valve member in a direction opposite to said one direction; and a control device connected to the piezoelectric device to control a polarity of voltage applied to the piezoelectric device for controlling a position of said needle valve member relative to said injection port.

2. A fuel injection valve according to claim 1, wherein said piezoelectric device comprises axially laminated piezoelectric elements interposed in said valve body for having applied thereto a positive or negative voltage to push said needle valve member in the direction opposite said one direction and to control the position of said needle valve member with respect to said injection port by applying a voltage switched over to a negative or positive voltage at a time of fuel injection.

3. A fuel injection valve according to claim 1, wherein said first spring member comprises a spring member for biasing said needle valve member in a direction which spaces said needle valve member apart from said injection port; and said piezoelectric device comprises a piezoelectric element for energizing said needle valve member in a direction in which said needle valve member approaches said injection port.

4. A fuel injection valve according to claim 1, wherein said first spring member comprises a spring member for energizing said needle valve member in a direction in which said needle valve member approaches said injection port, and said piezoelectric device comprises a piezoelectric element for energizing said needle valve member in a direction which spaces said needle valve member span from said injection pan.

5. A fuel injection valve according to claim 1, wherein said needle valve member comprises a hollow cylinder having openings formed on a side wall thereof, said first spring member is interposed between a first cover body screwed in an opening of said cylinder and a second cover body screwed in an opening of said valve body, said piezoelectric device is interposed between said first cover body and a connection portion for connecting side walls of said valve body.

6. A fuel injection valve according to claim 5, wherein said piezoelectric device comprises piezoelectric elements axially laminated and interposed in the valve body to have applied thereto a positive voltage.

7. A fuel injection valve according to claim 1, wherein said piezoelectric device includes a plurality of axially laminated piezoelectric elements.

8. A fuel injection valve comprising:

a valve body having an injection port at a tip portion thereof;

a needle valve member interposed in said valve body for opening or closing said injection port;

a first spring member interposed in said valve body for biasing said needle valve member in one direction;

a piezoelectric device comprising a piezoelectric element having a solid cylindrical body interposed in said valve body for pushing said needle valve member in a direction opposite to said one direction;

a control device connected to the piezoelectric device to control a polarity of voltage applied to the piezoelectric device for controlling a position of the net, die valve relative to the injection port; and a second spring member interposed between said valve body and said piezoelectric device for applying a larger biasing force to said piezoelectric device than the biasing force applied by said first spring member.

9. A fuel injection valve according to claim 8, wherein said second spring comprises a belleville spring.

10. A fuel injection valve comprising:

a valve body having an injection port at a tip portion of a small diameter portion thereof and a fuel injection inlet at a large diameter portion thereof;

a needle valve member including a first member of a small diameter having an inner valve interposed in the small diameter portion of said valve body, a second member interposed in the large diameter portion and a third member contacting said second member;

a first spring member comprising a coil spring interposed between said second member of said needle valve member and the large diameter portion for biasing said needle valve member in a direction of opening;

a piezoelectric device comprising a piezoelectric element of a solid cylinder interposed between said third member of said needle valve member and a cover portion of said valve body for controlling said needle valve portion in the direction of opening by contraction of the piezoelectric device when an applied voltage is interrupted;

a driving circuit for driving said piezoelectric device; and an EFI computer for controlling said driving circuit.

11. A fuel injection valve according to claim 10, further comprising:

a second spring member interposed between said piezoelectric device and an end portion of said large diameter portion and wherein said piezoelectric device comprises piezoelectric elements axially laminated and interposed in the valve body to have applied thereto a positive voltage.

* * * * *